US012599808B2

(12) United States Patent
Roh et al.

(10) Patent No.: US 12,599,808 B2
(45) Date of Patent: Apr. 14, 2026

(54) MAT-TYPE EXERCISE DEVICE

(71) Applicant: LG ELECTRONICS INC., Seoul (KR)

(72) Inventors: Jeongjoon Roh, Seoul (KR); Jeong Uk Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 107 days.

(21) Appl. No.: 18/701,291

(22) PCT Filed: May 24, 2023

(86) PCT No.: PCT/KR2023/007084
§ 371 (c)(1),
(2) Date: Apr. 15, 2024

(87) PCT Pub. No.: WO2024/019303
PCT Pub. Date: Jan. 25, 2024

(65) Prior Publication Data

US 2024/0408440 A1 Dec. 12, 2024

(30) Foreign Application Priority Data

Jul. 18, 2022 (KR) ..... 10-2022-0088528

(51) Int. Cl.
*A63B 21/00* (2006.01)
*A63B 71/00* (2006.01)

(52) U.S. Cl.
CPC ..... *A63B 21/4037* (2015.10); *A63B 21/4035* (2015.10); *A63B 71/0036* (2013.01)

(58) Field of Classification Search
CPC . A63B 21/0059; A63B 21/023; A63B 21/153; A63B 21/4033; A63B 21/4034;
(Continued)

(56) References Cited

U.S. PATENT DOCUMENTS 5,039,109 A * 8/1991 Mahoney ..... A63B 69/0097 248/647
9,750,980 B1 * 9/2017 Khalili ..... A63B 21/0004
(Continued)

FOREIGN PATENT DOCUMENTS

CN 112402922 A * 2/2021 ..... A63B 26/00
CN 212631588 3/2021
(Continued)

OTHER PUBLICATIONS

International Search Report dated Sep. 4, 2023 issued in Application No. PCT/KR2023/007084.
(Continued)

*Primary Examiner* — Gary D Urbiel Goldner
(74) *Attorney, Agent, or Firm* — KED & ASSOCIATES, LLP

(57) ABSTRACT

Proposed is a mat-type exercise device. The mat-type exercise device may include a plurality of wheel modules. Each of the plurality of wheel modules is installed in the device body such that the wheel module can move between a protrusion position at which the wheel module protrudes from the lower surface of the device body and a retraction position at which the wheel module is retracted to the inside of the lower surface of the device body. Additionally, a plurality of switching modules switches the position of at least one of the plurality of wheel modules between the protrusion position and the retraction position. Accordingly, the mat-type exercise device is secured to move horizontally when the wheel module is located at the protrusion position, and stable exercise is secured when the wheel module is located at the retraction position.

17 Claims, 14 Drawing Sheets

(58) Field of Classification Search
CPC ..... A63B 21/4035; A63B 21/4037; A63B 20/201; A63B 20/203; A63B 26/00; A63B 26/003; A63B 71/0036; A63B 71/0054; A63B 2071/0063; A63B 2071/0072; A63B 2071/009; A63B 2071/025
See application file for complete search history.

(56) References Cited

U.S. PATENT DOCUMENTS

| | | | | |
|---|---|---|---|---|
| 10,092,791 | B2 | 10/2018 | Donnelly et al. | |
| 12,350,542 | B1 * | 7/2025 | Nayak | A63B 71/023 |
| 2006/0100074 | A1 | 5/2006 | Murdoch | |
| 2019/0076691 | A1 | 3/2019 | Smith | |
| 2019/0344123 | A1 | 11/2019 | Rubin et al. | |
| 2021/0362001 | A1 * | 11/2021 | Crawley | A63B 21/4033 |
| 2024/0408436 | A1 * | 12/2024 | Kang | A63B 23/03525 |
| 2025/0242192 | A1 * | 7/2025 | Lee | A63B 21/0058 |
| 2025/0288850 | A1 * | 9/2025 | Nayak | A63B 21/00076 |

FOREIGN PATENT DOCUMENTS

| | | | | |
|---|---|---|---|---|
| KR | 20060023850 A | * | 3/2006 | A63B 23/035 |
| KR | 10-2053683 | | 12/2019 | |
| KR | 10-2158338 | | 11/2020 | |
| KR | 20230050202 A | * | 4/2023 | A63B 24/0006 |
| KR | 20230050203 A | * | 4/2023 | A63B 21/4035 |
| KR | 20240033922 A | * | 3/2024 | H02K 7/10 |
| KR | 20240107006 A | * | 7/2024 | A63B 24/0087 |
| WO | 44112733 | | 8/2024 | |

OTHER PUBLICATIONS

European Search Report dated Aug. 11, 2025 issued in Application No. 23843160.5.

* cited by examiner

MAT-TYPE EXERCISE DEVICE

CROSS-REFERENCE TO RELATED PATENT APPLICATIONS

This application is a U.S. National Stage Application under 35 U.S.C. § 371 of PCT Application No. PCT/KR2023/007084, filed May 24, 2023, which claims priority to Korean Patent Application No. 10-2022-0088528, filed Jul. 18, 2022, whose entire disclosures are hereby incorporated by reference.

TECHNICAL FIELD

The present disclosure relates generally to an exercise device and, more particularly, to a mat-type exercise device on which a user can exercise while the mat-type exercise device is seated on a floor.

BACKGROUND ART

In general, an exercise device used for increasing muscular strength is designed to repeat muscle relaxation and contraction while a lever connected to a weight of a predetermined unit of weight is pushed or pulled.

Among such exercise devices, there are various types of exercise devices, such as an arm curl machine for biceps exercises, a chest press or butterfly machine for exercises for chest, such as pectoralis major, and a pull-up device for a muscle exercise.

Recently, as part of self-management, a home workout, which is exercise for health management at home which is my own resting place without jogging or visiting a fitness center has become an issue. In response to this issue, various types of exercise devices for a home workout have been proposed, and a new phrase called a home workout group has been created.

Among exercise devices for a home workout, an exercise device, such as a mat-type exercise device, may be proposed for a user to exercise while standing on the associated exercise device.

It is preferable to secure the mobility of the mat-type exercise device such that a user moves the exercise device to a desired location to exercise. When the mat-type exercise device includes a component such as a motor, it is practically difficult for a user to directly carry the exercise device. Accordingly, in the case of the mat-type exercise device, it is preferable to ensure the free horizontal movement of the exercise device with respect to the floor.

However, even if the free horizontal movement of the mat-type exercise device is ensured, the free horizontal movement should not decrease a user's stability when the user exercises on the mat-type exercise device.

Accordingly, the mat-type exercise device whose horizontal movement is ensured and on which stable exercise can be performed is required.

DISCLOSURE OF INVENTION

Technical Problem

The present disclosure is intended to propose a mat-type exercise device whose horizontal movement is ensured and on which stable exercise can be performed.

Furthermore, the present disclosure is intended to propose a mat-type exercise device which can ensure stability even while a user steps on the mat-type exercise device in a state in which the mat-type exercise device can perform horizontal movement.

In addition, the present disclosure is intended to propose a mat-type exercise device in which manipulation for moving the mat-type exercise device, and manipulation for seating the mat-type exercise device on a floor for stable exercise are easy.

Furthermore, the present disclosure is intended to propose a mat-type exercise device in which multiple moving wheels can be retracted into and pulled out of a device body by one manipulation.

Solution to Problem

According to an embodiment of the present disclosure, a mat-type exercise device may include a device body. The device body may have a seating part. The device body according to the embodiment of the present disclosure may provide an exercise load necessary for exercise.

The mat-type exercise device according to the embodiment of the present disclosure may include a plurality of wheel modules. Each of the wheel modules may be installed in the device body to move vertically between a protrusion position and a retraction position. Here, at the protrusion position of the wheel module, the wheel module may protrude more downward than the seating part so as to move the device body. On the other hand, in the retraction position of the wheel module, the wheel module may move more upward than the seating part to allow the seating part to be in contact with the floor.

The mat-type exercise device according to the embodiment of the present disclosure may include a plurality of switching modules. Each of the plurality of switching modules may switch the position of at least one of the plurality of wheel modules between the protrusion position of the wheel module and the retraction position thereof.

The mat-type exercise device according to the embodiment of the present disclosure may include a plurality of safety modules. In the protrusion position of the wheel module, when additional weight is applied to the wheel module, each of the safety modules may move the wheel module to the retraction position in response to the additional weight so that the seating part can be in contact with the floor.

In one embodiment, the seating part may include a plurality of seating column parts protruding downward from a lower surface of the device body adjacent to each of the wheel modules.

The safety module according to the embodiment of the present disclosure may include an inner body and a damping spring. The inner body may be installed to move vertically in the wheel module. Additionally, the damping spring may be disposed between the wheel module and the inner body and may elastically support the wheel module and the inner body.

Here, when additional weight is applied to the wheel module, the elastic force of the damping spring may be overcome by the additional weight and thus the wheel module may move toward the retraction position relative to the inner body. Through this, the wheel module may move more upward than the seating part and thus the seating part may be in contact with the floor.

The wheel module according to the embodiment of the present disclosure may include a wheel body and a moving wheel. The inner body may be installed to move vertically in the wheel body. In addition, the wheel body may receive the damping spring, and the damping spring may be received under the inner body. In addition, the moving wheel may be coupled to the lower side of the wheel body.

The wheel module according to the embodiment of the present disclosure may further include one pair of wheel guide members. The one pair of wheel guide members may be installed in the device body such that the wheel guide members are respectively located on the opposite sides of the wheel body and may guide the vertical movement of the wheel body.

The wheel module according to the embodiment of the present disclosure may further include a guide piston. With the upper end of the guide piston fixed to the device body, the guide piston may extend downward.

The wheel module according to the embodiment of the present disclosure may further include a top cover. The top cover may have a first piston passage hole through which the guide piston passes. In addition, the top cover may cover the top of the wheel body.

In one embodiment, the inner body may have a second piston passage hole through which the guide piston extending to the inside of the wheel body through the first piston passage hole passes. Through this, the vertical movement of the inner body inside the wheel body may be guided by the guide piston.

The wheel module according to the embodiment of the present disclosure may further include a guide cylinder. The guide cylinder may be installed on the inner lower surface of the wheel body and may be disposed under the inner body. In addition, the lower end of the guide piston may be inserted into the guide cylinder. Here, the damping spring may be disposed between the bottom surface of the wheel body and the inner body to surround the guide cylinder.

The inner body according to the embodiment of the present disclosure may include a holding jaw part. The holding jaw part may have a first surface directed upward and a second surface directed downward.

The switching module according to the embodiment of the present disclosure may include a holding rib. In the protrusion position, the holding rib may be in contact with the first surface of the holding jaw part to maintain the protrusion position. In addition, in the retraction position, the holding rib may be in contact with the second surface of the holding jaw part to maintain the retraction position.

In one embodiment, the switching module may be installed in the device body so that the switching module can move between a holding position and a holding release position. Here, in the holding position of the switching module, the holding rib may be in contact with the first surface or the second surface of the holding jaw part. In addition, in the holding release position of the switching module, the holding rib may be removed from the first surface or the second surface of the holding jaw part.

The wheel module according to the embodiment of the present disclosure may further include a first clastic member. The first elastic member may press the wheel body toward the protrusion position. Through this, at the holding position at which the holding rib is in contact with the second surface of the holding jaw part, when the holding rib moves to the holding release position, the wheel body may be moved toward the protrusion position by the elastic force of the first elastic member.

In one embodiment, when the holding rib moves to the holding release position from the holding position at which the holding rib is in contact with the first surface of the holding jaw part, the device body moves to the protrusion position with the moving wheel in contact with the floor so that the weight of the device body overcomes the clastic force of the first elastic member, and the wheel body may move toward the retraction position.

In one embodiment, the second surface of the holding jaw part and the surface of the holding rib in contact with the second surface at the retraction position may be formed to be inclined by facing each other along the moving direction of the holding rib.

In one direction, the plurality of wheel modules may have each pair of wheel modules installed on the opposite edges of the device body in the longitudinal direction thereof so that the pair of wheel modules is disposed to be spaced apart from each other in the width direction. In addition, the plurality of switching modules may be installed respectively on the opposite sides of the device body in the longitudinal direction and may switch the positions of each pair of wheel modules.

The switching module according to the embodiment of the present disclosure may include a handle part and one pair of wheel switching parts. Here, the handle part may be exposed to the outside of the device body so that a user can grip the handle part. Additionally, in the device body, each of the one pair of wheel switching parts may extend from the opposite sides of the handle part in the width direction and may switch the position of each of the pair of wheel modules.

Here, the holding rib may be formed on each of the wheel switching parts. In addition, manipulation by the handle part may be transmitted through each of the wheel switching parts to the holding rib so that the holding rib can move between the holding position and the holding release position.

The handle part according to the embodiment of the present disclosure may include one pair of lever shaft parts. The one pair of lever shaft parts may be respectively coupled to the opposite ends of the handle part in the width direction so that the lever shaft parts can rotate in the device body.

In one embodiment, each of the wheel switching parts may include a middle link and a link tip. Here, the middle link may be rotatably coupled to the lever shaft part at a first side of the middle link which is spaced apart from the rotational shaft of the lever shaft part. In addition, the first side of the link tip may be rotatably coupled to the second side of the middle link, and the holding rib may be formed on the second side of the link tip.

Here, the link tip may be moved between the holding position and the holding release position by the rotation of the handle part relative to the rotational shaft of each of the one pair of lever shaft parts, and thus the holding rib formed on the second side of the link tip may move between the holding position and the holding release position.

The wheel switching part according to the embodiment of the present disclosure may further include a second elastic member. The second elastic member may elastically press the lever shaft part in a direction of locating the link tip at the holding position.

Each of the wheel guide members according to the embodiment of the present disclosure may have a switching guide groove extending along the longitudinal direction. In addition, each of the opposite ends of the link tip in the width direction may be inserted into the switching guide groove so that the movement of the holding rib between the holding position and the holding release position can be guided.

Advantageous Effects of Invention

The mat-type exercise device of the present disclosure may have one or more of the following effects.

First, the plurality of wheel modules may be configured to be moved into and out of the device body, thereby ensuring the horizontal movement of the mat-type exercise device when the wheel modules are located at protrusion positions, and ensuring a stable exercise with the mat-type exercise device when the wheel modules are located at retraction positions.

Second, in a state in which the plurality of wheel modules is located at the protrusion position and can move horizontally, when a user puts the feet on the mat-type exercise device, the movement of the exercise device due to the wheel module is prevented, thereby preventing a user's falling from the device.

Third, the plurality of wheel modules may be elastically supported against weights, thereby preventing the above-described user's falling from the exercise device and preventing damage to the device.

Fourth, the plurality of wheel modules may be installed in each pair by being spaced apart from each other in the width direction of the device body on the opposite sides of the device body in the longitudinal direction thereof, thereby enabling the horizontal movement of the mat-type exercise device with a small force.

Fifth, the wheel module may be moved out to the protrusion position by the clastic force of the elastic member only by manipulating the switching module after slightly raising one side of the device body, thereby providing the convenience of manipulation for moving the wheel module outside.

Sixth, the wheel module may be moved to the retraction position by the weight of the device body after only the switching module is manipulated, thereby providing the convenience of manipulation for moving the wheel module to the retraction position.

Seventh, one switching module may be configured to move two wheel modules in and out of the device body, thereby simplifying the movement of the wheel modules in and out the device body.

BEST MODE FOR CARRYING OUT THE INVENTION

A mat-type exercise device according to the embodiment of the present disclosure may include a plurality of wheel modules. Each of the wheel modules may be installed in a device body so as to move vertically between a protrusion position and a retraction position. Here, in the protrusion position of the wheel module, the wheel module may protrude more downward from a seating part to allow movement of the device body. On the other hand, in the retraction position of the wheel module, the wheel module moves more upward than the seating part to allow the seating part to be in contact with a floor.

Mode for the Invention

Hereinafter, a mat-type exercise device according to an embodiment of the present disclosure will be described in detail with reference to the accompanying drawings.

Figure 1:
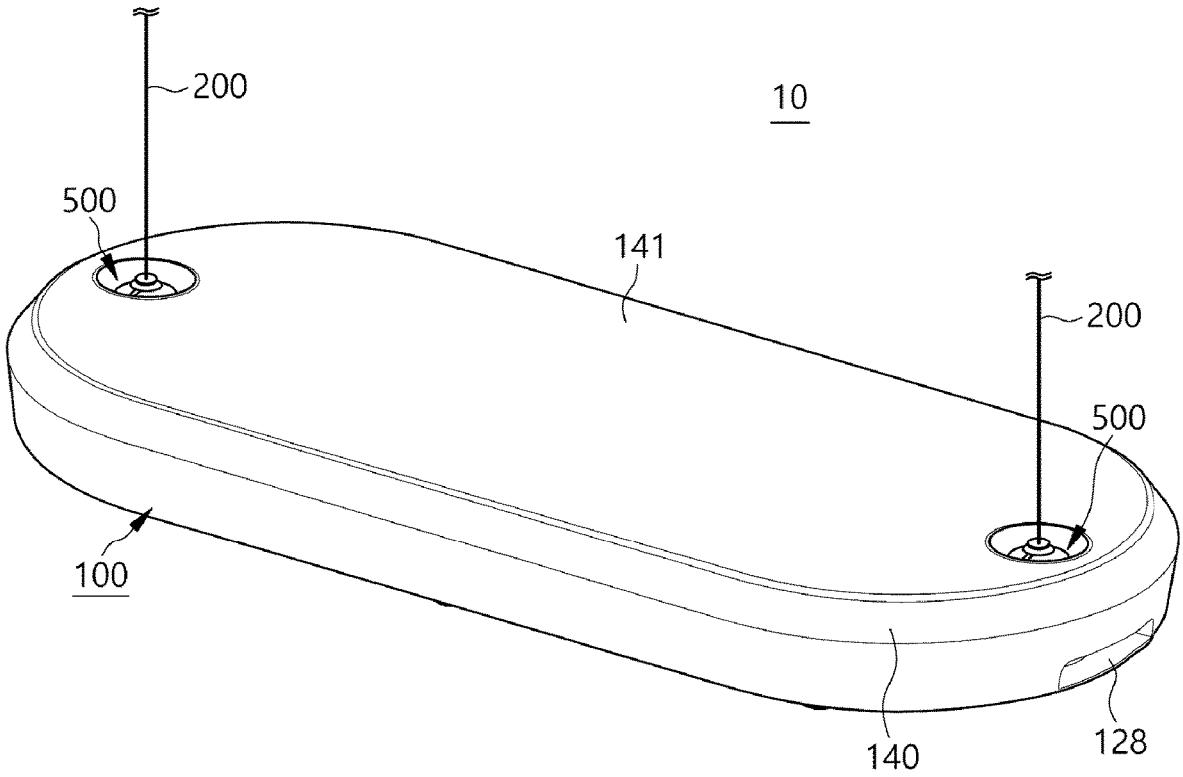
FIG. 1 is a perspective view of the mat-type exercise device according to the embodiment of the present disclosure when viewed from an upper side.
Figure 2:
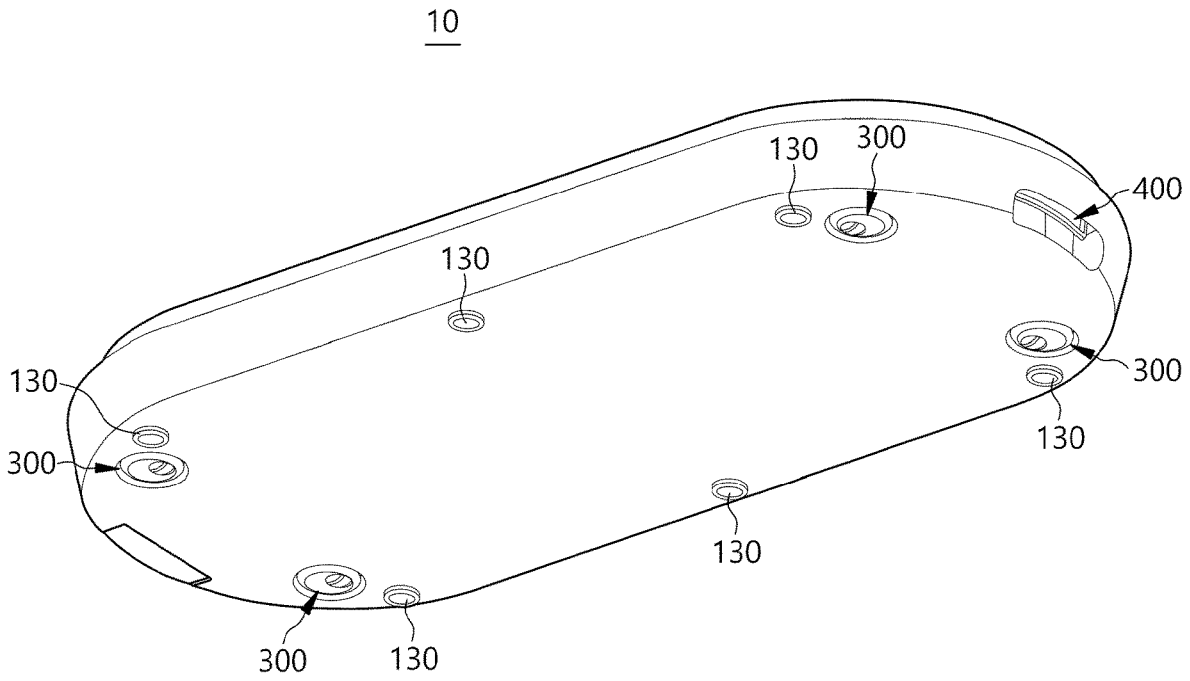
FIG. 2 is a perspective view of the mat-type exercise device according to the embodiment of the present disclosure when viewed from a lower side.

FIG. 1 is a perspective view of the mat-type exercise device 10 according to the embodiment of the present disclosure when viewed from an upper side, and FIG. 2 is a perspective view of the mat-type exercise device 10 according to the embodiment of the present disclosure when viewed from a lower side.

Referring to FIGS. 1 and 2, the mat-type exercise device 10 according to the embodiment of the present disclosure may be used in such a manner that a user exercises on the top of the mat-type exercise device 10 while the mat-type exercise device 10 is seated on the floor indoors or outdoors.

The mat-type exercise device 10 according to the embodiment of the present disclosure may include a device body 100. The device body 100 may constitute the entire exterior of the mat-type exercise device 10, and may have a planar shape of a race track shape when viewed from above.

The device body 100 according to the embodiment of the present disclosure has a shape in which length in a horizontal direction is longer than length in a direction perpendicular thereto, and hereinafter will be described by defining long horizontal direction as a longitudinal direction and defining a relatively short perpendicular direction as a width direction.

The mat-type exercise device 10 according to the embodiment of the present disclosure may include a cable 200. The cable 200 may extend outward from the device body 100 and may transmit an exercise load provided from the device body 100 to a user. That is, in the mat-type exercise device of the present disclosure, in an exercise process in which a user pulls the cable 200 and returns the same to an initial position, the user may exercise through the exercise load applied to the user when the cable is pulled.

Here, in the embodiment of the present disclosure, the cables 200 may be pulled out respectively from the opposite edges of the device body 100 in the longitudinal direction thereof. For example, a user may exercise by installing a gripper on each of one pair of cables 200 pulled out from the opposite sides of the device body 100. For another example, a user may exercise by connecting one pair of cables 200 pulled out respectively from the opposite sides of the device body 100 to the opposite ends of gripping rod.

Figure 3:
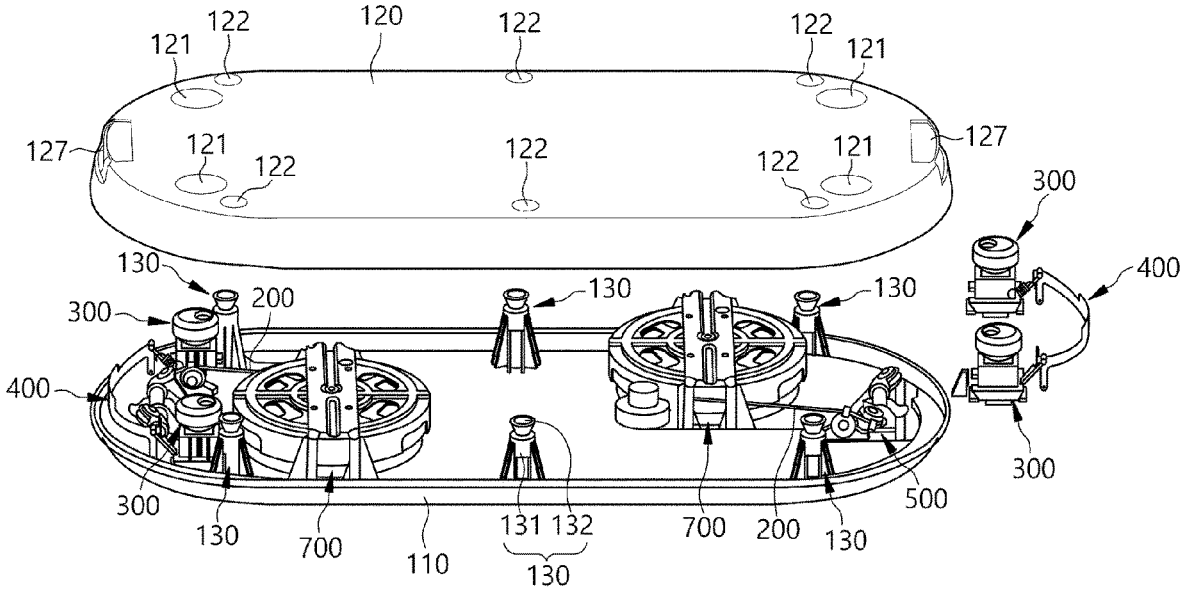
FIG. 3 is a partially exploded perspective view of a device body of the mat-type exercise device according to the embodiment of the present disclosure.

FIG. 3 is an exploded perspective view of the device body 100 of the mat-type exercise device 10 according to the embodiment of the present disclosure.

Referring to FIG. 3, the device body 100 according to the embodiment of the present disclosure may include an upper casing 110 and a lower casing 120. The upper casing 110 and the lower casing 120 may be vertically coupled to each other to define a receiving space inside. Here, as illustrated in FIG. 1, an outer casing may be coupled to the outside of the upper casing 110 and the lower casing 120, and the exterior of the device body 100 may be constituted by the outer casing.

Referring to FIG. 3, the mat-type exercise device 10 according to the embodiment of the present disclosure may include a drive motor 700 which provides an exercise load.

In the embodiment of the present disclosure, two drive motors 700 may be installed to independently supply exercise loads to the cables 200, respectively, pulled out from the opposite sides of the device body 100.

Through this, each of exercise loads of the cables 200 pulled out from the opposite sides of the device body 100 can be individually controlled, and a differential mechanism for transferring the rotation of one drive motor 700 to the opposite sides can be removed.

Accordingly, the structure of the mat-type exercise device 10 according to the embodiment of the present disclosure may be simplified, thereby enabling a compact design and removing noise and vibration caused by a differential mechanism.

In addition, the backlash of a differential gear occurring during the directional change of the cable 200 pulled and released due to the use of a differential mechanism is eliminated, and a rattling feeling during movement can also be eliminated.

In the embodiment of the present disclosure, the drive motor 700 is mounted to the upper casing 110, but the technical spirit of the present disclosure is not limited thereto.

In addition, the drive motor 700 according to the embodiment of the present disclosure may be disposed on each of the inner opposite edges of the device body 100 in the longitudinal direction thereof so that the drive motors 700 are biased from a longitudinal directional center.

Meanwhile, the mat-type exercise device 10 according to the embodiment of the present disclosure may further include one pair of handle guide modules 500 which are installed respectively on the opposite sides of the device body 100 in the longitudinal direction thereof and respectively guide the cables 200 extending from the drive motors 700 inside the device body 100 to the outside of the device body 100.

The handle guide modules 500 according to the embodiment of the present disclosure may be installed on the opposite edges of the device body 100 in the longitudinal direction, and in the present disclosure, may be mounted to the upper casing 110 of the device body 100 as illustrated in FIG. 3.

Here, when the cable 200 extending from the drive motor 700 is pulled out of the device body 100, each of the handle guide modules 500 allows the movement of the cable 200 toward the surface of the device body 100 to be stably performed.

In the embodiment of the present disclosure, the handle guide module 500 may be installed in a through hole 112 of the cable 200 formed through the surface of the upper casing 110.

Meanwhile, the device body 100 according to the embodiment of the present disclosure may include a seating part. The seating part may support the device body 100 by touching the floor when the device body 100 is seated on the floor.

In the embodiment of the present disclosure, the seating part may include a plurality of seating column parts 130. In the present disclosure, as illustrated in FIGS. 2 and 3, each of the seating column parts 130 may protrude downward from a lower surface of the device body 100 adjacent to each of the plurality of wheel modules 300 to be described later.

In addition, one pair of seating column parts 130 may be disposed in the central portion of the device body 100 in the longitudinal direction by being spaced apart from each other in the width direction. Through this, the device body 100 may be more stably seated on the floor.

In the embodiment of the present disclosure, as illustrated in FIG. 3, each of the seating column parts 130 may include an extension column 131 and a seating member 132.

The extension column 131 according to the embodiment of the present disclosure may extend downward from the lower surface of the upper casing 110. In the embodiment of the present disclosure, as an example, the extension column 131 is manufactured integrally with the upper casing 110, but a separate extension column 131 may be mounted to the lower surface of the upper casing 110.

The seating member 132 may be coupled to the lower end of the extension column 131. The seating member 132 is made of, for example, a rubber material having elasticity, and can support the device body 100 to be in stable contact with the floor. Here, the lower casing 120 may have a plurality of column passage holes 122 through which the lower end of the extension column 131 extending from the upper casing 110 toward the lower casing 120 passes. Through this, when the upper casing 110 and the lower casing 120 are vertically coupled to each other, the seating member 132 coupled to the end of the extension column 131 may protrude downward from the lower surface of the lower casing 120 and may be in contact with the floor when the device body 100 is seated on the floor.

In the embodiment of the present disclosure, the seating part has the plurality of seating column parts 130 protruding from the lower casing 120, but the downward lower surface of the lower casing 120 (or the outer casing covering the outside of the lower casing 120) may constitute the seating part. Alternatively, multiple protruding parts (not shown) protruding from the lower casing 120 may constitute the seating part.

Figure 4:
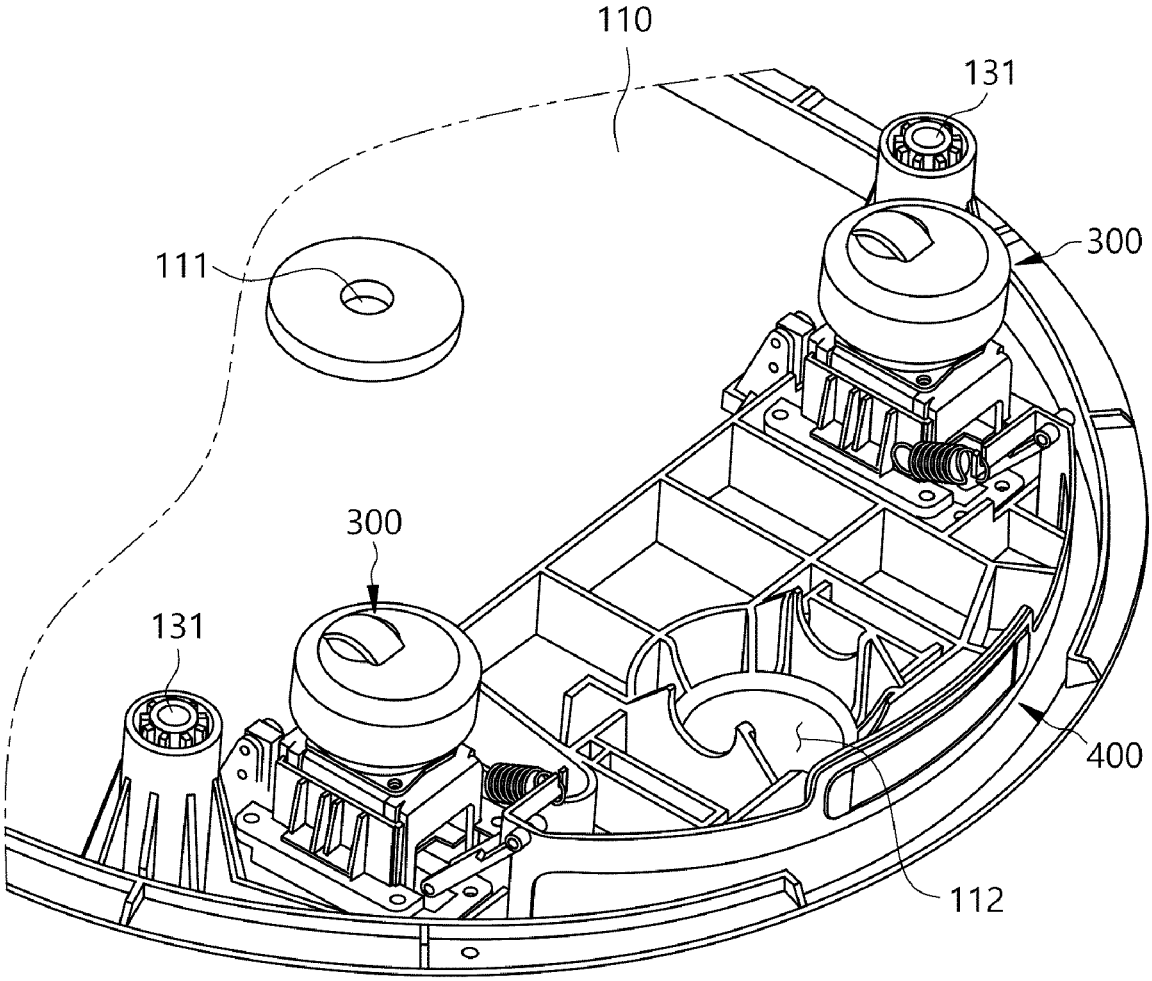
FIG. 4 is a perspective view illustrating one portion of the lower surface of an upper casing of the mat-type exercise device according to the embodiment of the present disclosure.
Figure 5:
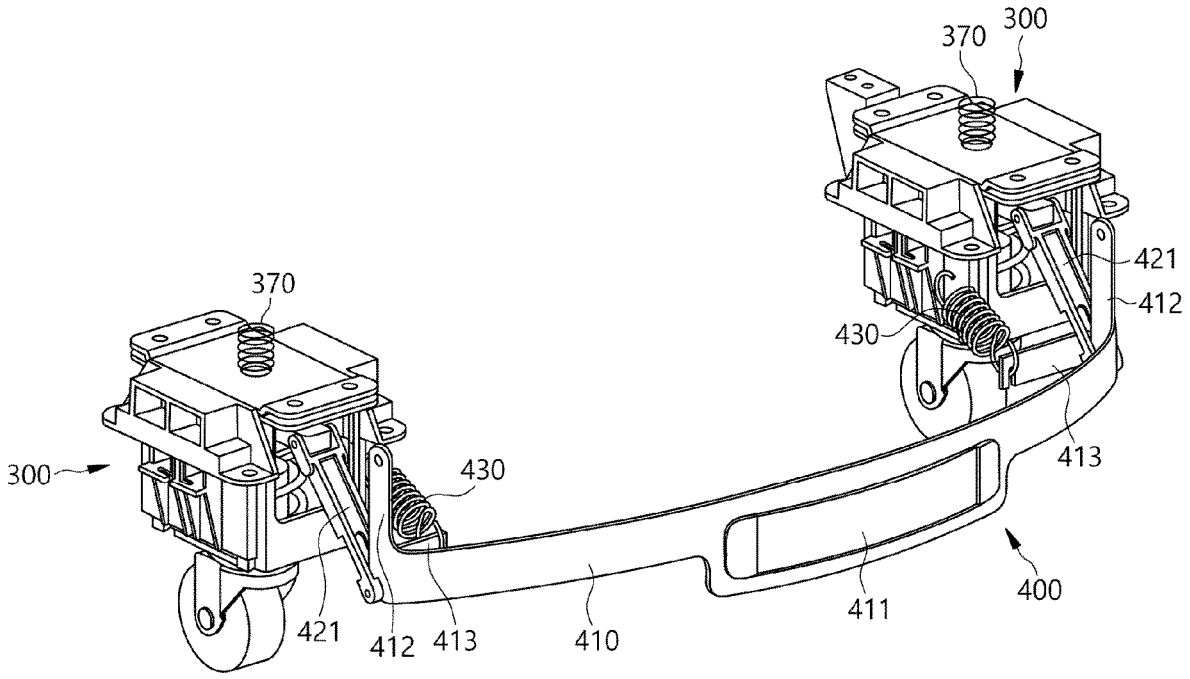
FIG. 5 is a perspective view of a wheel module and a switching module of the mat-type exercise device according to the embodiment of the present disclosure.

FIG. 4 is a perspective view illustrating one portion of the lower surface of the upper casing 110 of the mat-type exercise device 10 according to the embodiment of the present disclosure, and FIG. 5 is a perspective view of the wheel module 300 and a switching module 400 of the mat-type exercise device 10 according to the embodiment of the present disclosure.

The mat-type exercise device 10 according to the embodiment of the present disclosure may include the plurality of wheel modules 300. In the embodiment of the present disclosure, the plurality of wheel modules 300 has each pair of wheel modules 300 installed on the opposite sides of the device body 100 in the longitudinal direction thereof so that the pair of wheel modules 300 is disposed respectively on width directional opposite sides by being spaced apart from each other in the width direction.

Each of the plurality of wheel modules 300 according to the embodiment of the present disclosure is installed in the device body 100 to move in a vertical direction between a protrusion position and a retraction position. Here, in the protrusion position, the wheel module 300 may protrude more downward than the seating part to allow the movement of the device body 100. Additionally, in the retraction position, the wheel module 300 may move more upward than the seating par to allow the seating part to touch the floor.

As described above, when the seating part is constituted by the plurality of seating column parts 130, in the protrusion position, the wheel modules 300 may protrude more downward than the plurality of seating column parts 130. For another example, when the seating part is constituted by the lower surface of the device body 100 or by multiple protruding parts protruding from the lower surface, the wheel modules 300 may protrude more downward than the lower surface or the multiple protruding parts to allow the movement of the device body 100.

In the embodiment of the present disclosure, through a wheel moving hole formed through the surface of the lower casing 120, each of the wheel modules 300 may move between the protrusion position and the retraction position.

In addition, as illustrated in FIG. 3, each of the wheel modules 300 may be inserted into a wheel retraction hole 121 recessed inward from the lower surface of the lower casing 120 so that the wheel module 300 moves to the retraction position. Furthermore, the wheel moving hole may be formed vertically through the inner surface of each of the wheel retraction holes 121.

Accordingly, when the seating part of the device body 100 is seated on the ground in a state in which each of the plurality of wheel modules 300 is located at the retraction position at which the wheel module is retracted into the wheel retraction hole, the seating part may be in close contact with the ground such that exercise can be stably performed.

On the other hand, when each of the plurality of wheel modules 300 is moved to the protrusion position to move the mat-type exercise device 10, each of the wheel modules 300 may be in contact with the ground and the seating part may be spaced apart from the ground so that the horizontal movement of the mat-type exercise device 10 can be performed.

The mat-type exercise device 10 according to the embodiment of the present disclosure may include a plurality of switching modules 400 as illustrated in FIG. 3.

The plurality of switching modules 400 may switch the position of at least one of the plurality of wheel modules 300 between the protrusion position of the wheel module and the retraction position thereof. In the embodiment of the present disclosure, as illustrated in FIG. 3, two switching modules 400 may be installed at each of opposite sides of the device body 100 in the longitudinal direction thereof, and may switch the positions of each pair of wheel modules 300. That is, one switching module 400 installed at a first side in the longitudinal direction may switch the positions of a pair of wheel modules 300 spaced apart from each other in the width direction, and one switching module 400 installed at a second side in the longitudinal direction may switch the positions of a pair of wheel modules 300 spaced apart from each other in the width direction.

Through this, a user may move one pair of wheel modules 300 between the retraction position and the protrusion position by manipulating one switching module 400 so that the wheel module 300 can be more simply manipulated.

Accordingly, a user may move the one pair of wheel modules 300 between the retraction position and the protrusion position by manipulating one switching module 400, thereby manipulating the wheel module 300 more conveniently.

Meanwhile, the mat-type exercise device 10 according to the embodiment of the present disclosure may include a plurality of safety modules 380 and 390.

In the protrusion position of the wheel module 300, when additional weight is applied to the wheel module 300, each of the safety modules 380 and 390 may move the wheel module 300 toward the retraction position in response to the additional weight so as to allow the seating part to be in contact with the floor.

For example, when a user steps on the device body 100 in a situation in which the wheel module 300 is located in the protrusion position, either intentionally or unintentionally, the user may fall from the device body 100 due to the movement of the device body 100 by the wheel module 300.

Accordingly, according to the present disclosure, when additional weight is applied to the device body 100 due to a user stepping on the device body 100 in the protrusion position of the wheel module 300, the safety module 380 and 390 may move the wheel module 300 toward the retraction position to allow the seating part to be in contact with the floor. Accordingly, the seating part may be in contact with the floor, which prevents the horizontal movement of the device body 100 by the wheel module 300, thereby preventing the risk of accidents.

Here, the plurality of safety modules 380 and 390 may be respectively installed inside the wheel modules 300 to respond to additional weight.

Figure 6:
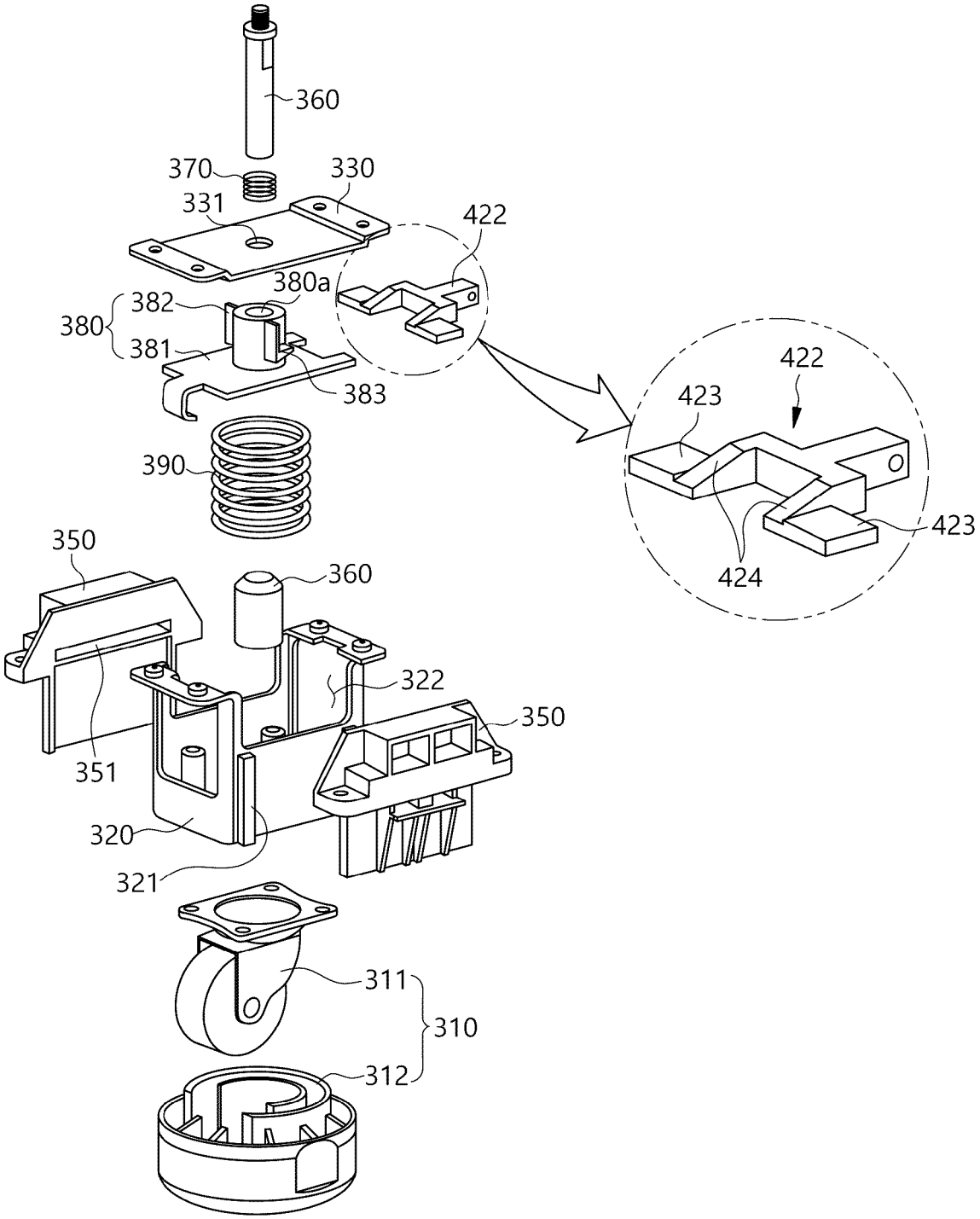
FIG. 6 is an exploded perspective view of the wheel module and a safety module of the mat-type exercise device according to the embodiment of the present disclosure.

FIG. 6 is an exploded perspective view of the wheel module 300 and the safety module 380 and 390 of the mat-type exercise device 10 according to the embodiment of the present disclosure.

Referring to FIG. 6, the safety module 380 and 390 according to the embodiment of the present disclosure may include an inner body 380 and a damping spring 390.

The inner body 380 according to the embodiment of the present disclosure may be installed to move vertically in the wheel module 300. Here, the inner body 380 may include an inner plate 381 and a holding rod 382. The inner plate 381 may be provided in a plate shape. Furthermore, the holding rod 382 may protrude upward from the inner plate 381 and may have a holding jaw part 383 to be described later.

The damping spring 390 according to the embodiment of the present disclosure may be disposed between the wheel module 300 and the inner body 380 so as to elastically support the wheel module 300 and the inner body 380.

Here, the clastic modulus of the damping spring 390 may be preset such that the damping spring 390 resists the weight of the mat-type exercise device 10 according to the embodiment of the present disclosure but is overcome by additional weight generated when a user's feet are placed on the device body so that the movement of the wheel module 300 is allowed relative to the inner body 380.

For example, in the embodiment of the present disclosure, damping springs 390 are respectively installed inside four wheel modules 300 and may have stiffness to the extent that the damping springs are not compressed even if the damping springs receive weight of about ¼ of the weight of the mat-type exercise device 10 according to the embodiment of the present disclosure. For example, in a case in which the weight of the mat-type exercise device 10 according to the embodiment of the present disclosure is 40 kg, one damping spring 390 may not be compressed when receiving weight of at least 10 kg, but may be compressed when receiving weight exceeding 10 kg.

According to the above configuration, when additional weight is not applied with the wheel module 300 located in the protrusion position, the weight of the mat-type exercise device 10 may be resisted to allow the horizontal movement of the wheel module 300.

On the other hand, when additional weight is applied as described above with the wheel module 300 located in the protrusion position, the movement of the wheel module 300 to the retraction position relative to the inner body 380 may be allowed. Accordingly, due to the movement of the wheel module 300 to the retraction position, the seating part may be in contact with the floor, and the horizontal movement of the device body 100 may be prevented.

The wheel module 300 according to the embodiment of the present disclosure may include a wheel body 320 and a moving wheel 310 as an example.

Inside the wheel body 320 according to the embodiment of the present disclosure, the inner body 380 of the safety module 380 and 390 may be installed to move vertically. Here, the damping spring 390 may be disposed on the lower part of the inner body 380 inside the wheel body 320 and, particularly, may be disposed between the bottom surface of the wheel body 320 and the lower surface of the inner body 380.

The moving wheel 310 may be coupled to the lower side of the wheel body 320. In the embodiment of the present disclosure, the moving wheel 310 may be provided in the form of a caster wheel 311 capable of rotating relative to a vertical directional axis. Through this, due to the rotation relative to the vertical directional axis of the moving wheel 310, the device body 100 may move freely in a horizontal direction.

In the embodiment of the present disclosure, the moving wheel 310 may include the caster wheel 311 and a wheel housing 312. Here, the wheel housing 312 may be coupled to the caster wheel 311 so as to expose the lower end of the caster wheel 311 to a side under the wheel housing 312 (see FIG. 8) and to surround the caster wheel 311, and may rotate together with the rotation of the caster wheel 311. The wheel housing 312 may protect the caster wheel 311 from external impact and may constitute the exterior of the moving wheel 310.

The wheel module 300 according to the embodiment of the present disclosure may further include a top cover 330. In the embodiment of the present disclosure, the wheel body 320 may have an approximate cuboid shape having an open top, and the top cover 330 may cover the top of the wheel body 320.

In addition, the wheel module 300 according to the embodiment of the present disclosure may further include a guide piston 340. With the upper end of the guide piston 340 fixed to the device body 100, the guide piston 340 may extend downward into the wheel body 320. Here, the top cover 330 may have a first piston passage hole 331 through which the guide piston 340 passes, and the lower portion of the guide piston 340 may extend into the wheel body 320.

In addition, the inner body 380 may have a second piston passage hole 380*a* through which the guide piston 340 extending to the inside of the wheel body 320 through the first piston passage hole 331 passes. Here, the second piston passage hole 380*a* may be formed vertically through the holding rod 382 and the inner plate 381. Accordingly, when the inner body 380 moves vertically inside the wheel body 320, the inner body 380 may be guided by the guide piston 340 passing through the second piston passage hole 380*a*.

The wheel module 300 according to the embodiment of the present disclosure may further include a guide cylinder 360. The guide cylinder 360 may be installed on the inner lower surface of the wheel body 320, that is, on a bottom surface thereof and may be disposed under the inner body 380, particularly, between the inner body 380 and the wheel body 320.

Here, the lower end of the guide piston 340 may be inserted into the guide cylinder 360. That is, with the upper end of the guide piston 340 fixed to the device body 100, the lower end of the guide piston 340 may be inserted into the guide cylinder 360, and as described above, the guide piston may guide not only the vertical movement of the inner body 380, but also the vertical movement of the wheel body 320. In addition, the damping spring 390 may surround the guide cylinder 360 and may be disposed between the lower surface of the inner body 380 and the bottom surface of the wheel body 320.

The wheel module 300 according to the embodiment of the present disclosure may further include a wheel guide member 350.

The wheel guide member 350 may be installed inside the device body 100 and may be fixed to the upper casing 110 in the embodiment of the present disclosure. Here, the wheel guide member 350 may guide the movement of the wheel body 320 between the protrusion position and the retraction position.

In the embodiment of the present disclosure, one wheel module 300 may include one pair of wheel guide members 350. The one pair of wheel guide members 350 may guide the vertical movement of the wheel body 320 at each of the width directional opposite sides of the device body 100.

In the embodiment of the present disclosure, as illustrated in FIG. 6, the wheel body 320 may one pair of wheel guide bars 321 protruding toward the wheel guide member 350. Additionally, the wheel guide member 350 may be fitted between the one pair of wheel guide bars 321 to guide the vertical movement of the wheel body 320.

Meanwhile, as described above, the holding jaw part 383 may be formed on the holding rod 382 of the inner body 380. The holding jaw part 383 according to the embodiment of the present disclosure may include a first surface 383*a* directed upward and a second surface 383*b* directed downward. Additionally, the switching module 400 may include a holding rib 424.

Figure 7A:
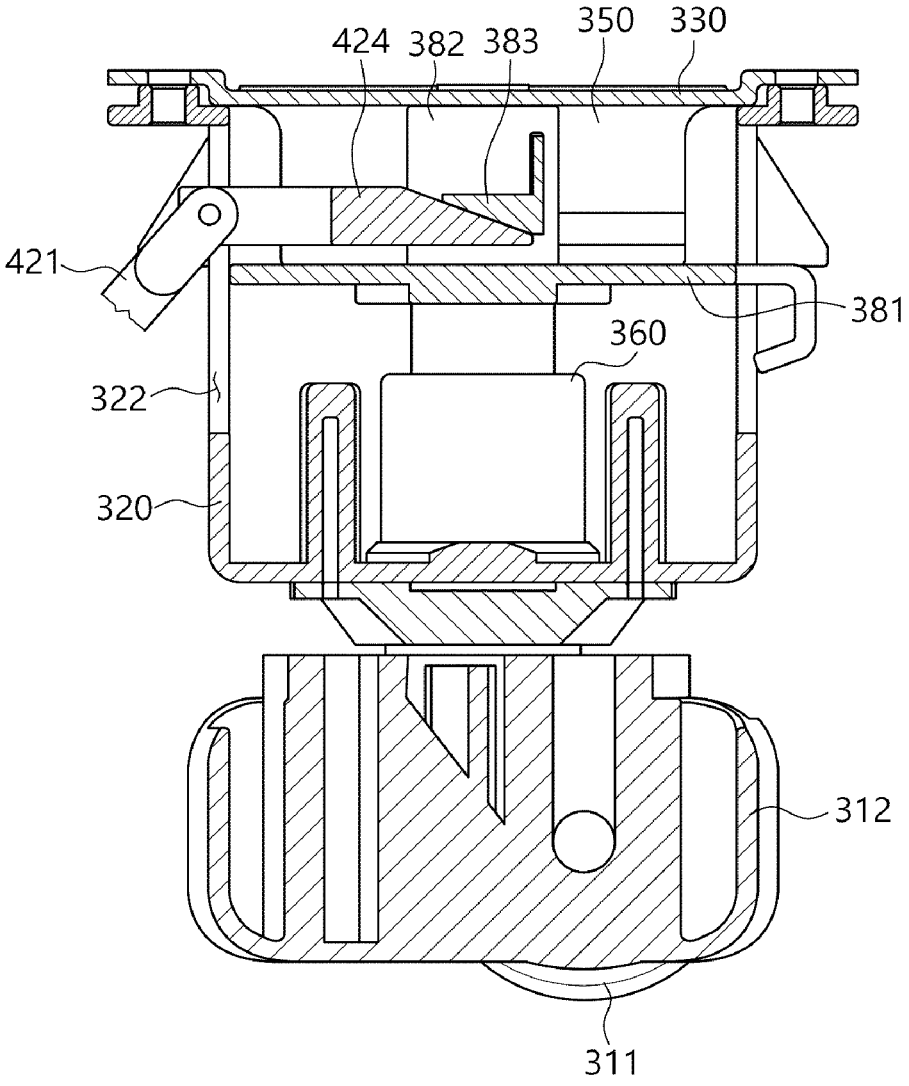
FIGS. 7*a* to 7*d* are views illustrating the operation process of the wheel module and the switching module of the mat-type exercise device according to the embodiment of the present disclosure.
Figure 7B:
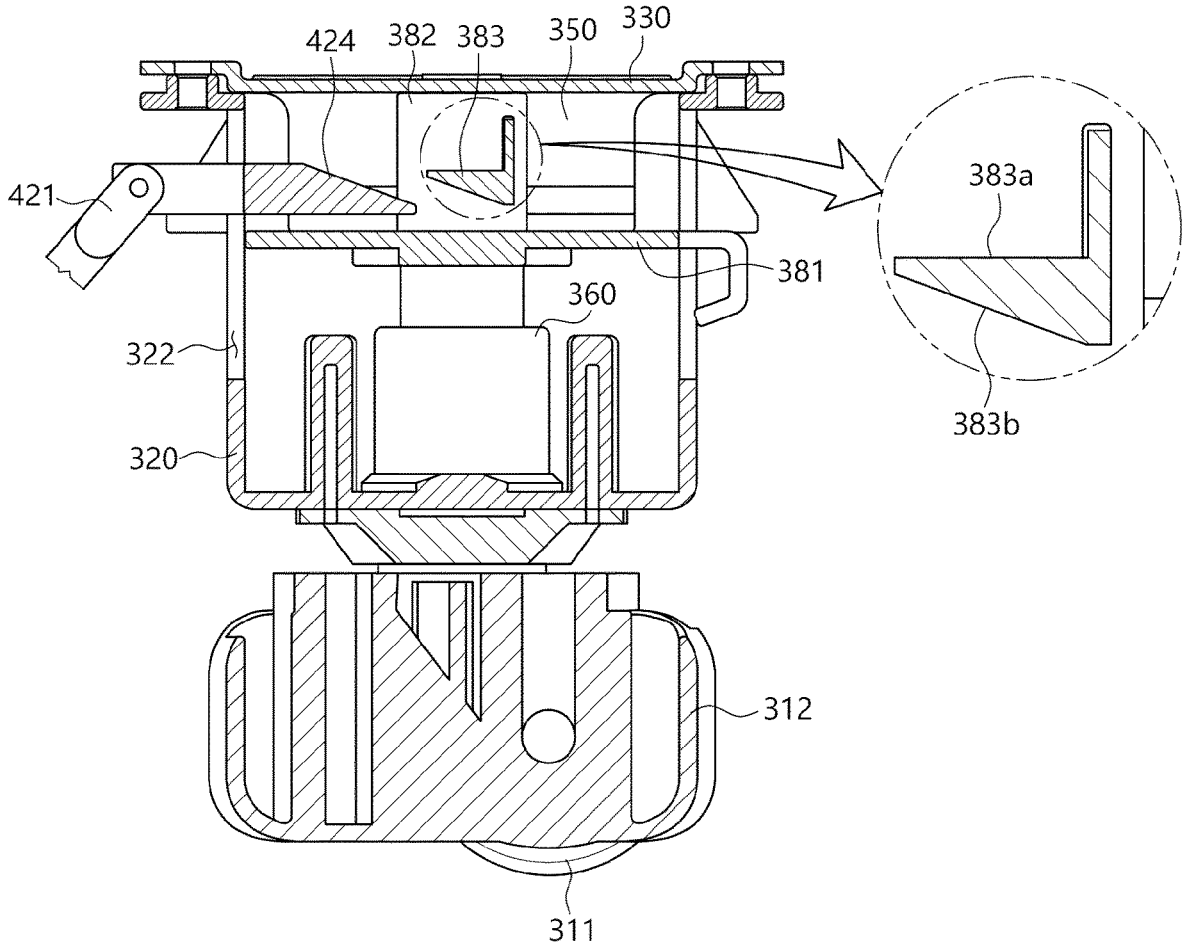
Figure 7C:
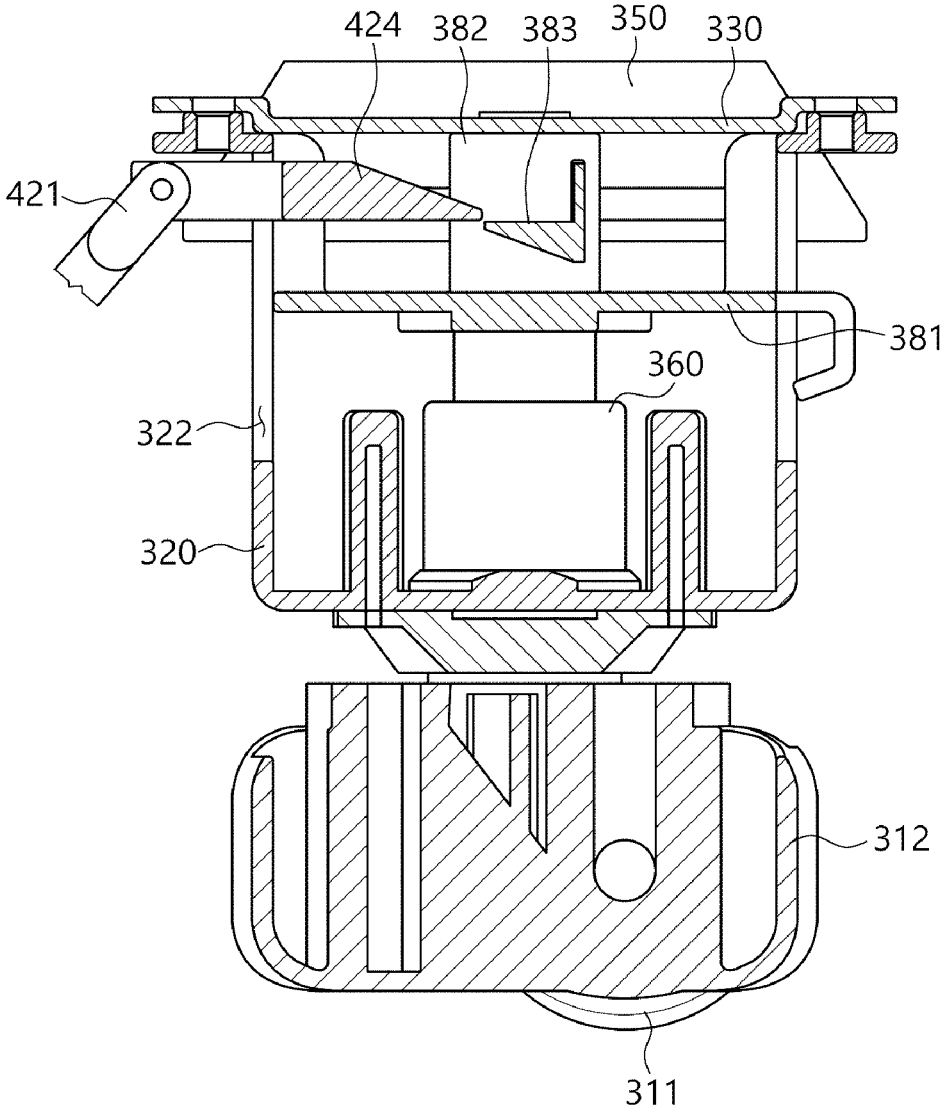
Figure 7D:
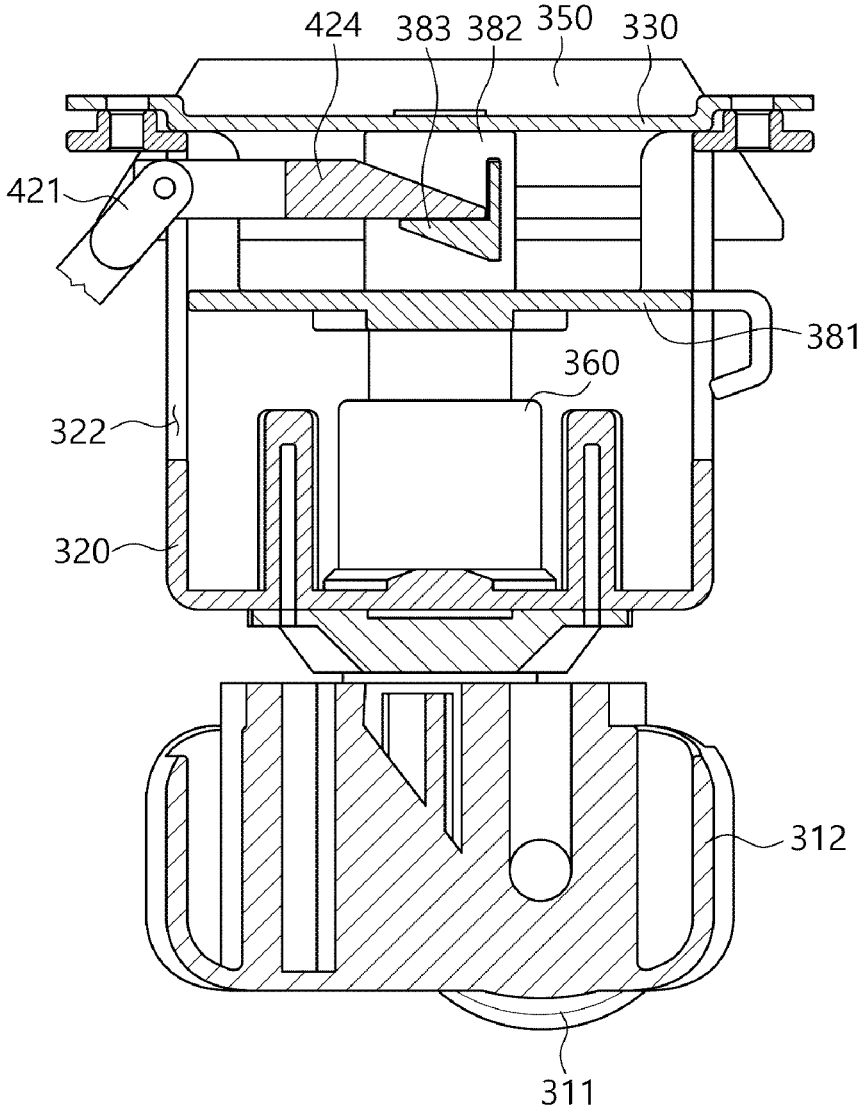

Referring to FIGS. 7*a* to 7*d*, the holding rib 424 may be in contact with the first surface 383*a* of the holding jaw part 383 at the protrusion position of the wheel module 300 as illustrated in FIG. 7*d* so as to maintain the protrusion position of the wheel module 300. That is, in a state in which the wheel module 300 is moved to the protrusion position, when the wheel module 300 supports the weight of the device body 100, the holding rib 424 may be in contact with the first surface 383*a* of the holding jaw part 383, and thus the movement of the wheel module 300 to the retraction position may be prevented by the weight of the device body 100.

In addition, as illustrated in FIG. 7*a*, the holding rib 424 may be in contact with the second surface 383*b* of the holding jaw part 383 at the retraction position of the wheel module 300 so as to maintain the retraction position of the wheel module 300. That is, in a state in which the wheel module 300 is moved to the retraction position, the holding rib 422 may be in contact with the second surface 342*b* of the holding jaw part, and thus the wheel module 300 may be prevented from being moved to the protrusion position.

In the embodiment of the present disclosure, the switching module 400 may be installed in the device body 100 such that the holding rib 422 can move between a holding position at which the holding rib 422 is in contact with the first surface 383*a* or the second surface 383*b* of the holding jaw part 383 as illustrated in FIGS. 7*a* and 7*d* and a holding release position at which the holding rib 424 is released from the first surface 383*a* or the second surface 383*b* as illustrated in FIGS. 7*b* and 7*c*.

According to the above configuration, a user may manipulate the switching module 400 to move the switching module 400 between the holding position and the holding release position such that the wheel module 300 is moved between the protrusion position and the retraction position. More specifically, in order to move the wheel module 300 from the retraction position to the protrusion position, a user may move the switching module 400 from the holding position illustrated in FIG. 7*a* to the holding release position illustrated in FIG. 7*b* such that the holding rib 424 in contact with the second surface 383*b* of the holding jaw part 383 is released from the second surface 383*b*.

Next, as illustrated in FIG. 7*c*, in order to move the wheel module 300 from the retraction position to the protrusion position, the switching module 400 may be moved from the holding release position back to the holding position illustrated in FIG. 7*d*, and thus the protrusion position of the wheel module 300 may be maintained by the holding rib 424 in contact with the first surface 383*a* of the holding jaw part 383.

Here, even when moving the wheel module 300 from the protrusion position to the retraction position, the holding rib 424 of the switching module 400 may be moved to the holding release position in the same manner described above, and thus the vertical movement of the wheel module 300 may be performed.

Meanwhile, the wheel module 300 according to the embodiment of the present disclosure may further include a first elastic member 370. The first elastic member 370 may press the wheel body 320 toward the protrusion position. In the embodiment of the present disclosure, the first elastic member 370 may be installed between the top cover 330 and the upper casing 110 to press the top cover 330 downward so that the wheel body 320 is pressed toward the protrusion position.

Accordingly, when the holding rib 424 is moved from a holding position at which the holding rib 424 is in contact with the second surface 383*b* of the holding jaw part 383 to a holding release position, the wheel body 320 may be moved to the protrusion position by the clastic force of the first elastic member 370. Accordingly, without a user artificially moving the wheel module 300 from the retraction position to the protrusion position, the wheel module 300 may be automatically moved to the protrusion position by the elastic force of the first elastic member 370.

On the other hand, when the holding rib 424 is moved from a holding position at which the holding rib 424 is in contact with the first surface 383*a* of the holding jaw part 383 to the holding release position, the wheel module 300 may not be moved to the retraction position by the clastic force of the first elastic member 370, but while the device body 100 is moved in a downward direction in a state in which the moving wheel 310 is in contact with a floor such as the ground at the protrusion position, the weight of the device body 100 may overcome the clastic force of the first clastic member 370, and the wheel module 300 may be retracted into the device body 100.

That is, when moving the wheel module 300 to the protrusion position in a state in which the mat-type exercise device 10 is seated on the floor, a user may raise a first side of the device body 100 in the longitudinal direction while moving the holding rib 424 to the holding release position by manipulating the switching module 400 at the first side in the longitudinal direction, and in this case, the wheel module 300 may be moved toward the protrusion position by the elastic force of the first elastic member 370. In this case, when a user places the device body 100 on the floor after moving the holding rib 424 to the holding position by manipulating the switching module 400, as described above, the holding rib 424 may be in contact with the first surface 383*a* of the holding jaw part 383, and thus the protrusion position of the wheel module 300 may be maintained. In the same manner, by manipulating the switching module 400 at a second side in the longitudinal direction, the wheel module 300 at the second side in the longitudinal direction may be also moved to the protrusion position.

Contrarily, when moving the wheel module 300 to the retraction position in a state in which the wheel module 300 is at the protrusion position, a user may grab and lower the first side of the device body 100 in the longitudinal direction toward the floor while moving the holding rib 424 to the holding release position by manipulating the switching module 400 at the first side in the longitudinal direction, and in this case, the clastic force of the first clastic member 370 may be overcome by the weight of the device body 100, and while the device body 100 moves down toward the floor, the wheel module 300 may be moved to the retraction position. Here, when a user raises the first side of the device body 100 in the longitudinal direction, the wheel body 320 may move toward the protrusion position by the elastic force of the first elastic member 370, and the holding rib 424 and the first surface 383*a* of the holding jaw part 383 may be spaced apart from each other, so the holding rib 424 of the switching module 400 may be efficiently moved from the holding position to the holding release position. Additionally, when a user moves the switching module 400 to the holding position, the holding rib 424 may be in contact with the second surface 383*b* of the holding jaw part 383, and thus the retraction position of the wheel module 300 may be maintained. In the same manner, by manipulating the switching module 400 at the second side in the longitudinal direction, the wheel module 300 at the second side in the longitudinal direction may also be moved to the retraction position.

Here, in the embodiment of the present disclosure, as illustrated in FIGS. 7*a* to 7*d*, the second surface 383*b* of the holding jaw part 383 is configured to be inclined according to the moving direction of the holding rib 424. Additionally, at the retraction position, the surface of the holding rib 424 in contact with the second surface 383*b* of the holding jaw part 383 is configured to be inclined by facing the inclined surface of the second surface 383*b*.

Accordingly, at the holding position illustrated in FIG. 7*a*, frictional force between the second surface 383*b* of the holding jaw part 383 and the holding rib 424, particularly, frictional force increased by the first elastic member 370 may be overcome, and the switching module 400 may be more efficiently moved to the holding release position.

Through the above configuration, in the mat-type exercise device 10 according to the embodiment of the present disclosure, the operation process of the safety module 380 and 390 will be described with reference to FIGS. 8*a* to 8*c*.

Figure 8A:
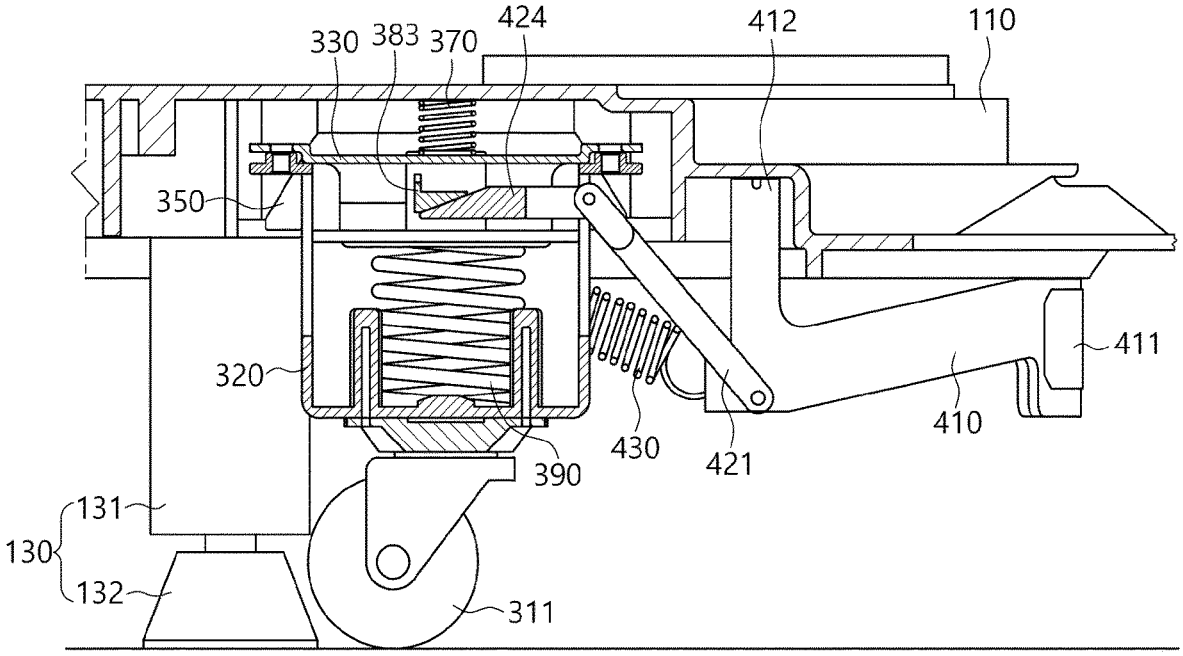
FIGS. 8*a* to 8*c* are views illustrating the operation process of the safety module of the mat-type exercise device according to the embodiment of the present disclosure.

As illustrated in FIG. 7*a*, FIG. 8*a* is a view illustrating a state in which the wheel module 300 according to the embodiment of the present disclosure is located in the retraction position. When the wheel module 300 is located in the retraction position, the holding rib 424 may be in contact with the second surface 383*b* of the holding jaw part 383, and the seating column part 130 may be in contact with the floor.

Figure 8B:
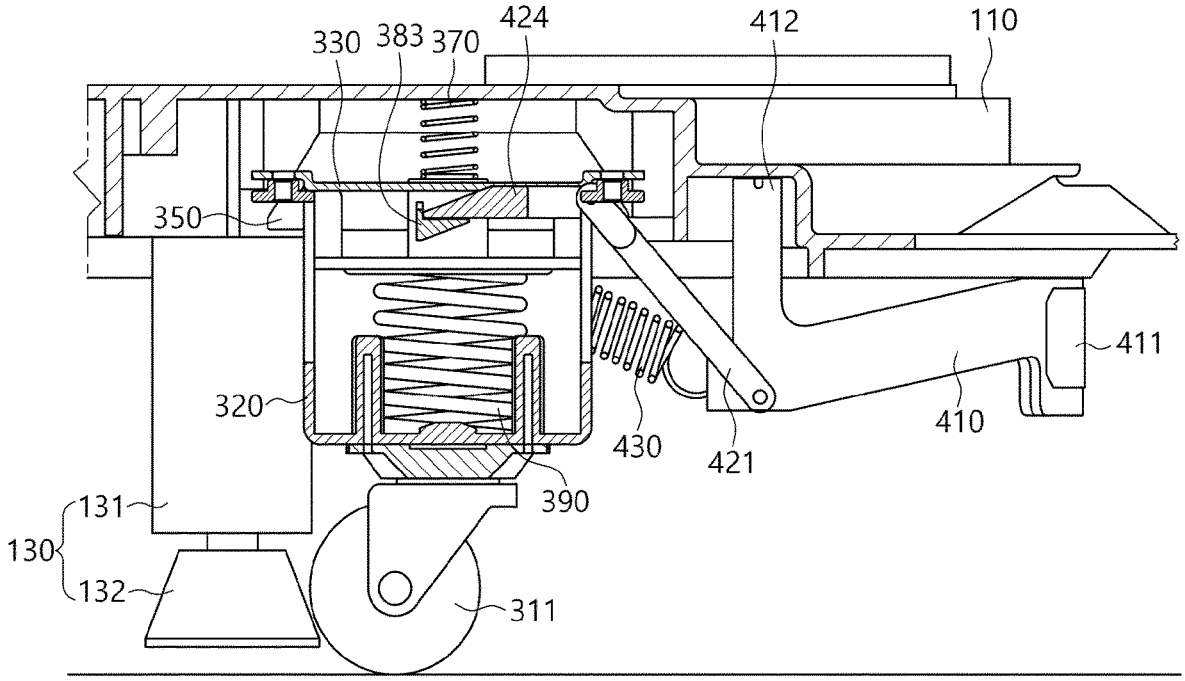

As illustrated in 7*d*, FIG. FIG. 8*b* is a view illustrating a state in which the wheel module 300 is located in the protrusion position. Here, when the wheel module 300 is located in the protrusion position, the protrusion position of the wheel module 300 may be maintained due to contact of the holding rib 424 with the second surface 383*b* of the holding jaw part 383, and the horizontal movement of the device body 100 may be ensured with the damping spring 390 supporting the weight of the device body 100.

In this case, in the horizontal movement of the device body 100, when an irregular load occurs due to bending of the floor, the damping spring 390 may perform a function like a shock absorber of a vehicle, thereby mitigating impact applied to the device body 100.

Figure 8C:
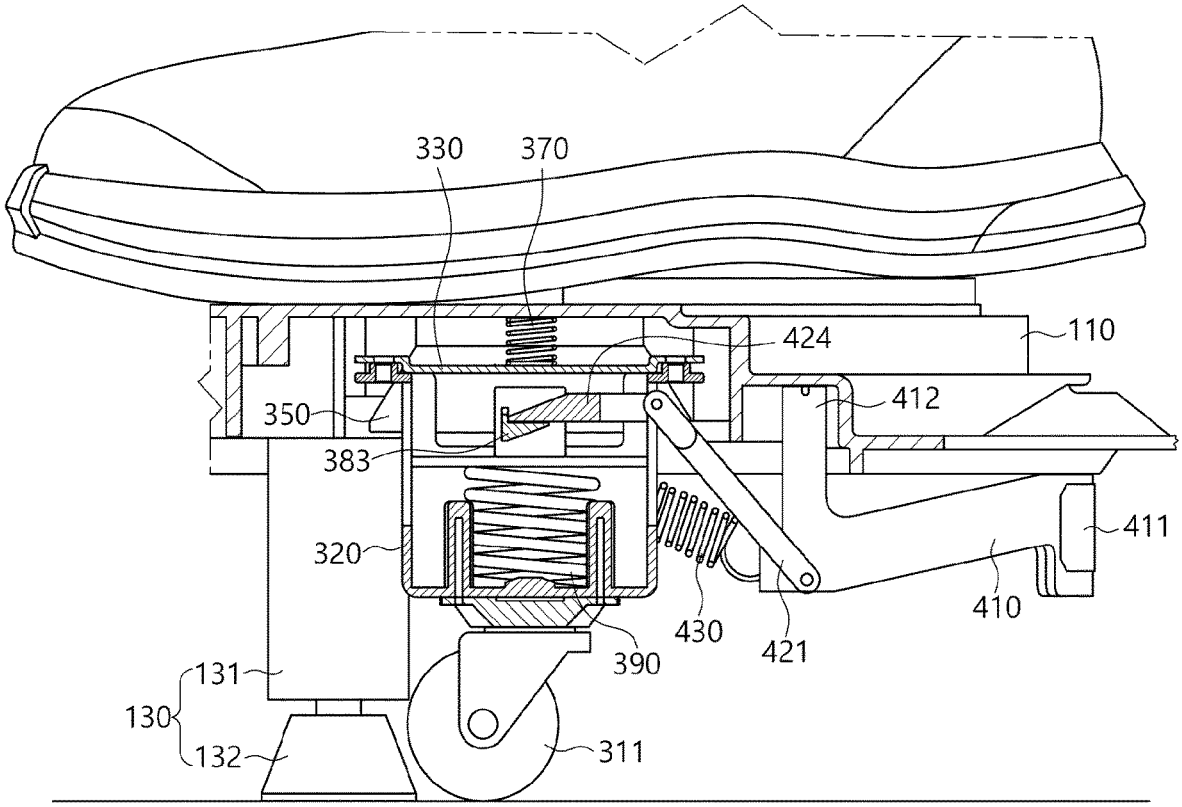
Figure 9:
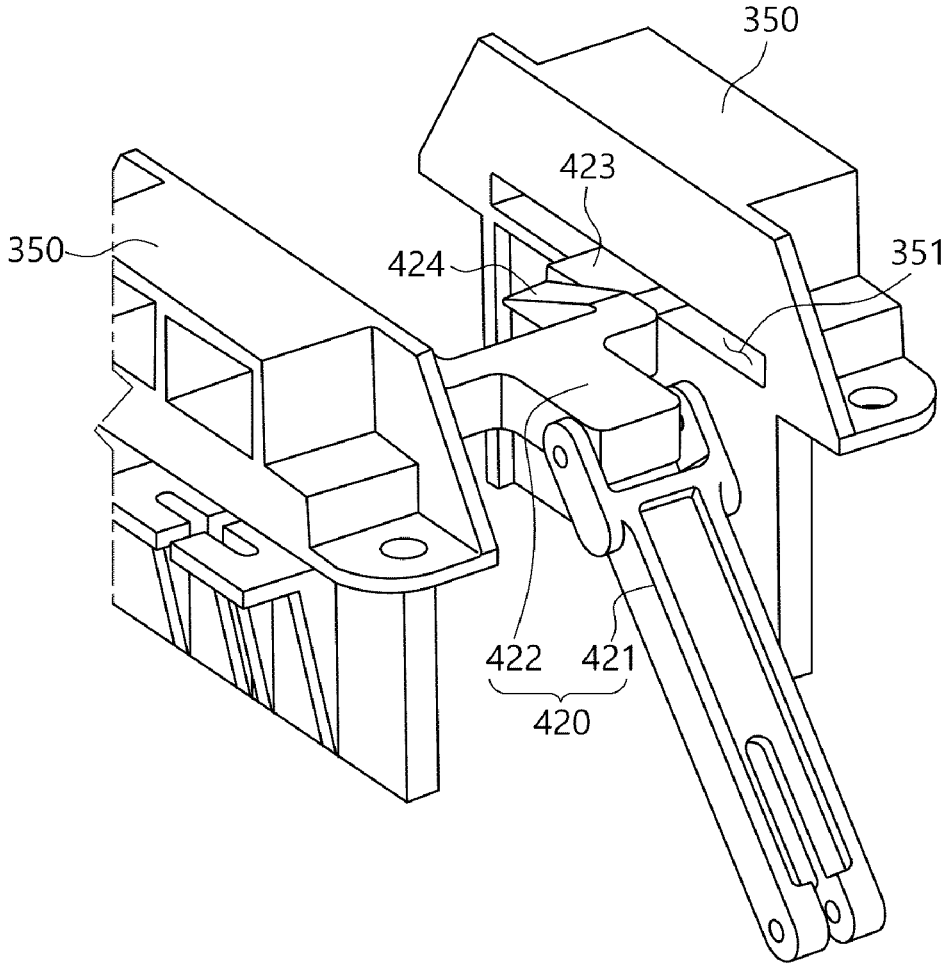
FIG. 9 is a view illustrating a coupled state between a wheel guide member and a link tip of the mat-type exercise device according to the embodiment of the present disclosure.

As illustrated in FIG. 8*b*, with the wheel module 300 located in the protrusion position, when additional weight is applied to the device body 100 like a situation in which a user puts the feet on the device body 100 as illustrated in FIG. 8*c*, the clastic force of the damping spring 390 may be overcome by the additional weight and the wheel module 300 may move to the retraction position since the first surface 383*a* of the holding jaw part 383 formed in the inner body 380 is in contact with the holding rib 424 and the movement of the inner body 380 to the retraction position is prevented. In addition, due to the movement of the wheel module 300 to the retraction position, the seating column part 130 may be in contact with the floor to stop the horizontal movement of the device body 100 so that accidents can be prevented.

Referring back to FIGS. 4 and 5, the switching module 400 according to the embodiment of the present disclosure may include a handle part 410 and one pair of wheel switching parts 420.

In the mat-type exercise device of the present disclosure, the handle part 410 may be disposed in a switching installation part 127 (see FIG. 3) formed in the lower casing 120. The switching installation part 127 may have a shape open to the lower side and may have space in which the handle part 410 can be located. In addition, the handle part 410 may be located in the space of the switching installation part 127, and thus the handle part 410 may be exposed to the lower side.

Here, the handle part 410 may be configured as a double structure into which a flexible member 411 is inserted so that a user can grip the handle part 410 more conveniently.

Through such a configuration, a user may raise the device body 100 by putting the fingers into the switching installation part 127 open to the lower side, and may also manipulate the handle part 410.

Inside the device body 100, the one pair of wheel switching parts 420 may respectively extend from the handle part 410 to the opposite sides of the device body in the width direction thereof. Additionally, each of the wheel switching parts 420 may switch the position of the wheel module 300 located at each of opposite sides in the width direction.

Here, the holding rib 424 may be formed on each of the wheel switching parts 420. Additionally, manipulation by the handle part 410 may be transmitted through each of the wheel switching parts 420 to the holding rib 424 such that the holding rib 422 moves between the holding position and the holding release position.

In the embodiment of the present disclosure, the handle part 410 may include one pair of lever shaft parts 412. The one pair of lever shaft parts 412 may be coupled respectively to the opposite ends of the handle part 410 in the width direction so that the lever shaft parts 412 can rotate inside the device body 100. In the embodiment of the present disclosure, the lever shaft parts 412 may respectively extend upward from the opposite ends of the handle part 410, and the upper end of each of the lever shaft parts may be rotatably coupled to the upper casing 110.

In addition, each of the wheel switching parts 420 according to the embodiment of the present disclosure may include a middle link 421 and the link tip 422.

The middle link 421 according to the embodiment of the present disclosure may be rotatably coupled to the lever shaft part 412 at a first side of the middle link which is spaced apart from the rotational shaft of the lever shaft part 412. In addition, a second side of the middle link 421 may be disposed to be directed toward the wheel module 300.

A first side of the link tip 422 may be rotatably coupled to the second side of the middle link 421, and a second side of the link tip 422 may be retracted into the wheel body 320 of the wheel module. Here, as illustrated in FIG. 6, the holding rib 424 may be formed on the second side of the link tip 422. Here, as illustrated in FIG. 6, a tip inlet 322 may be formed in the wheel body 320 so that the link tip 422 connected to the second side of the middle link 421 can be retracted into the wheel body 320.

Each of the one pair of wheel guide members 350 according to the embodiment of the present disclosure may have a switching guide groove 351 extending along the longitudinal direction of the device body 100. In addition, a switching guide rib 423 inserted into the switching guide groove 351 may be formed on each of the opposite ends of the link tip 422 in the width direction.

Through this, the link tip 422 may reciprocate along the switching guide groove 351, and according to the reciprocation of the link tip 422, the holding rib 424 formed on the link tip 422 may move between the holding position and the holding release position.

According to the above configuration, when a user pulls the handle part 410, the handle part 410 may rotate relative to the rotational shaft of each of the one pair of lever shaft parts 412, and the middle link 421 spaced apart from the rotational shaft of the lever shaft part 412 may be moved backward by the rotation of the handle part 410.

In addition, the link tip 422 connected to the second side of the middle link 421 may also move according to the backward movement of the middle link 421, and may move toward the holding release position according to the guidance of the switching guide groove 351, so the holding rib 424 may move to the holding release position.

Here, the wheel switching part 420 according to the embodiment of the present disclosure may further include a second elastic member 430 which elastically presses each of the lever shaft parts 412 in a direction of locating the link tip 422 at the holding position.

The second clastic member 430 may provide elasticity in a direction in which the holding position of the holding rib 424 is maintained. Accordingly, when a user releases the handle part 410 at the holding release position, the lever shaft part 412 may be rotated by the second elastic member 430, and the link tip 422 connected to the middle link 421 may move to the holding position.

In the embodiment of the present disclosure, connecting bars 413 may be respectively formed by extending inward in the width directions from the opposite ends of the handle part 410. In addition, the first side of the second elastic member 430 may be connected to each of the connecting bars 413, and the second side thereof may be connected to the wheel guide member 350 so that elastic force is provided to the lever shaft part 412. Here, the connecting bar 413 may be formed at a side opposite to the rotational shaft of the lever shaft part 412, and the efficient rotation of the lever shaft part 412 may be ensured by the elastic force of the second elastic member 430.

Although the embodiment of the present disclosure has been described above with reference to the accompanying drawings, the exercise device of the present disclosure is not limited to the above embodiment, but may be manufactured in various different forms. Those skilled in the technical field to which the present disclosure belongs will be able to understand that the exercise device of the present disclosure may be embodied in other specific forms without changing the technical idea or essential characteristics of the present disclosure. Therefore, it should be understood that the embodiment described above is illustrative in all respects and not restrictive.

DESCRIPTION OF THE REFERENCE NUMERALS IN THE DRAWINGS

10: Mat-type exercise device 100: Device body
110: Upper casing 111: Upper shaft part
112: Cable through hole 120: Lower casing
121: Wheel retraction hole 122: Column passage hole
127: Switching installation part 130: Seating column part
131: Extension column 132: Seating member
200: Cable 300: Wheel module
310: Moving wheel 311: Caster wheel
312: Wheel housing 320: Wheel body
321: Wheel guide bars 322: Tip inlet
330: Top cover 331: First piston passage hole
340: Guide piston 350: Wheel guide member
351: Switching guide groove 360: Guide cylinder
370: First elastic member 380: Inner body
380*a*: Second piston passage hole 381: Inner plate
382: Holding rod 383: Holding jaw part
383*a*: First surface 383*b*: Second surface
390: Damping spring 400: Switching module
410: Handle part 411: Flexible member
412: Lever shaft part 413: Connecting bar
420: Wheel switching part 421: Middle link
422: Link tip 423: Switching guide rib
424: Holding rib 430: Second elastic member
500: Handle guide module 700: Drive motor

INDUSTRIAL APPLICABILITY

The present disclosure may be applied to an exercise device on which a user can perform muscle exercise.

The invention claimed is:

1. A mat exercise device comprising:

a device body which includes a seating part;

a plurality of wheel modules installed in the device body such that each of the plurality of wheel modules is capable of moving between a protrusion position at which the corresponding wheel module protrudes more downward than the seating part so as to move the device body, and a retraction position at which the corresponding wheel module moves more upward than the seating part to allow the seating part to be in contact with a floor;

a plurality of switching modules which switches a position of at least one of the plurality of wheel modules between the protrusion position of the at least one of the plurality of wheel modules and the retraction position of the at least one of the plurality of wheel modules; and a plurality of safety modules which respectively moves the plurality of wheel modules to the retraction position in response to additional weight so that the seating part is in contact with the floor when the additional weight is respectively applied to the plurality of wheel modules.

2. The device of claim 1, wherein the seating part comprises a plurality of seating column parts protruding downward from a lower surface of the device body respectively adjacent to each of the plurality of wheel modules.

3. The device of claim 1, wherein:

each safety module comprises:

an inner body which is installed to move vertically in the corresponding wheel module; and a damping spring which is disposed between the corresponding wheel module and the inner body and elastically supports the corresponding wheel module and the inner body; and when the additional weight is applied to the corresponding wheel module, an elastic force of the damping spring is overcome by the additional weight and thus the corresponding wheel module moves toward the retraction position relative to the inner body.

4. The device of claim 3, wherein each wheel module comprises:

a wheel body in which the inner body is installed to move vertically, and the damping spring is received under the inner body in the wheel body; and a moving wheel coupled to a lower side of the wheel body.

5. The device of claim 4, wherein each wheel module further comprises one pair of wheel guide members which are installed in the device body such that the one pair of wheel guide members are respectively located on opposite sides of the wheel body and guide the vertical movement of the wheel body.

6. The device of claim 4, wherein:

each wheel module further comprises a guide piston which extends downward with an upper end of the guide piston fixed to the device body, and a top cover which comprises a first piston passage hole through which the guide piston passes and covers a top of the wheel body; and the inner body comprises a second piston passage hole through which the guide piston extending to an inside of the wheel body through the first piston passage hole passes such that the vertical movement of the inner body inside the wheel body is guided by the guide piston.

7. The device of claim 6, wherein:

each wheel module further comprises a guide cylinder which is installed on an inner lower surface of the wheel body and disposed under the inner body such that a lower end of the guide piston is inserted into the guide cylinder; and the damping spring is disposed between a bottom surface of the wheel body and the inner body to surround the guide cylinder.

8. The device of claim 4, wherein:

the inner body comprises a holding jaw part which has a first surface directed upward and a second surface directed downward; and each switching module comprises a holding rib which is in contact with the first surface of the holding jaw part to maintain the corresponding wheel module in the protrusion position, and is in contact with the second surface of the holding jaw part to maintain the corresponding wheel module in the retraction position.

9. The device of claim 8, wherein the plurality of switching modules are installed in the device body so that each switching module moves between a holding position at which the holding rib is in contact with the first surface or the second surface of the holding jaw part and a holding release position at which the holding rib is removed from the first surface or the second surface of the holding jaw part.

10. The device of claim 9, wherein:

each wheel module further comprises a first elastic member which presses the wheel body toward the protrusion position; and when the holding rib moves to the holding release position from the holding position at which the holding rib is in contact with the second surface of the holding jaw part, the wheel body is moved toward the protrusion position by an elastic force of the first elastic member.

11. The device of claim 10, wherein when the holding rib moves to the holding release position from the holding position at which the holding rib is in contact with the first surface of the holding jaw part, the device body moves to the protrusion position with the moving wheel in contact with the floor so that a weight of the device body overcomes the elastic force of the first elastic member, and the wheel body moves toward the retraction position.

12. The device of claim 9, wherein the second surface of the holding jaw part and a surface of the holding rib in contact with the second surface at the retraction position are formed to be inclined by facing each other along a moving direction of the holding rib.

13. The device of claim 9, wherein:

the plurality of wheel modules comprises two pairs of wheel modules respectively installed on opposite edges of the device body in a longitudinal direction thereof so that a pair of wheel modules is disposed to be spaced apart from each other in a width direction; and the plurality of switching modules is installed respectively on opposite sides of the device body in the longitudinal direction and respectively switches the positions of each pair of wheel modules.

14. The device of claim 13, wherein:

each switching module comprises:

a handle part which is exposed to an outside of the device body such that a user can grip the handle part; and one pair of wheel switching parts which respectively extend from opposite sides of the handle part in the width direction and switch the position of each of the pair of wheel modules; and the holding rib is formed on each of the wheel switching parts and manipulation by the handle part is transmitted through each of the wheel switching parts to the holding rib such that the holding rib moves between the holding position and the holding release position.

15. The device of claim 14, wherein the handle part comprises one pair of lever shaft parts respectively coupled to the opposite sides of the handle part in the width direction such that the lever shaft parts rotate in the device body;

each of the wheel switching parts comprises:

a middle link rotatably coupled to the corresponding lever shaft part at a first side of the middle link which is spaced apart from a rotational shaft of the lever shaft part; and a link tip comprising a first side rotatably coupled to a second side of the middle link and a second side on which the holding rib is formed; and the link tip is moved between the holding position and the holding release position by the rotation of the handle part relative to the rotational shaft of each of the one pair of lever shaft parts.

16. The device of claim 15, wherein each of the wheel switching parts further comprises a second elastic member which elastically presses the corresponding lever shaft part in a direction of locating the link tip at the holding position.

17. The device of claim 16, wherein:

each of the wheel guide members comprises a switching guide groove extending along the longitudinal direction; and each of opposite ends of the link tip in the width direction is configured to be inserted into the corresponding switching guide groove such that movement of the holding rib between the holding position and the holding release position is guided.

* * * * *